United States Patent [19]

Okamoto et al.

[11] 4,351,212

[45] Sep. 28, 1982

[54] ELECTRONIC MUSICAL INSTRUMENT WITH EQUALLY SPACED BINARY NOTE CODES

[75] Inventors: Shimaji Okamoto; Yohei Nagai, both of Hamamatsu, Japan

[73] Assignee: Nippon Gakki Seizo Kabushiki Kaisha, Japan

[21] Appl. No.: 141,826

[22] Filed: Apr. 21, 1980

[30] Foreign Application Priority Data

Apr. 23, 1979 [JP] Japan ..... 54-50012

[51] Int. Cl.[3] ..... G10H 1/00

[52] U.S. Cl. ..... 84/1.01; 84/454

[58] Field of Search ..... 84/1.01, 454, DIG. 18; 364/701

[56] References Cited

U.S. PATENT DOCUMENTS 3,979,996 9/1976 Tomisawa et al. ..... 84/1.25
4,148,017 4/1979 Tomisawa ..... 84/1.01 X
4,215,614 8/1980 Chibana ..... 84/1.01
4,256,003 3/1981 Deutsch ..... 84/1.01

*Primary Examiner*—David Smith, Jr.
*Assistant Examiner*—Forester W. Isen
*Attorney, Agent, or Firm*—Townsend and Townsend

[57] ABSTRACT

An electronic musical instrument comprises a note code producer for producing note codes respectively having n bits representing juxtaposed notes aligned by a semitone interval step. The note codes to be generated are selected from a binary code table consisting of successively aligned binary values corresponding to an order of alignment of the notes in a musical scale and the table omits either one of the largest and smallest values to be represented by the lowest m bits (n>m). A modified note code generator produces modified note codes by repetitively adding the lowest m bits of each note code to further lower order digits below the least significant bit of each note code, and a sound system generates musical tones having frequencies corresponding to the modified note codes.

10 Claims, 7 Drawing Figures

| OUTPUT OF COUNTER 23 | OUTPUT PT OF LOGIC CKT 24 | | VARIATION MANNER OF PITCH MODIFYING SIGNAL PT (IN CENTS) |
|---|---|---|---|
| | HIGHEST BIT | LOWEST 5 BITS | |
| (MSB) (LSB) | | | |
| 0 0 0 0 0 0 0 | 0 | 0 0 0 0 0 | |
| 0 0 0 0 0 0 1 | 0 | 0 0 0 0 1 | |
| ⋮ | ⋮ | ⋮ | |
| 0 0 1 1 1 1 0 | 0 | 1 1 1 1 0 | |
| 0 0 1 1 1 1 1 | 0 | 1 1 1 1 1 | |
| 0 1 0 0 0 0 0 | 0 | 1 1 1 1 1 | |
| 0 1 0 0 0 0 1 | 0 | 1 1 1 1 0 | |
| ⋮ | ⋮ | ⋮ | |
| 0 1 1 1 1 1 0 | 0 | 0 0 0 0 1 | |
| 0 1 1 1 1 1 1 | 0 | 0 0 0 0 0 | |
| 1 0 0 0 0 0 0 | 1 | 1 1 1 1 1 | |
| 1 0 0 0 0 0 1 | 1 | 1 1 1 1 0 | |
| ⋮ | ⋮ | ⋮ | |
| 1 0 1 1 1 1 0 | 1 | 0 0 0 0 1 | |
| 1 0 1 1 1 1 1 | 1 | 0 0 0 0 0 | |
| 1 1 0 0 0 0 0 | 1 | 0 0 0 0 0 | |
| 1 1 0 0 0 0 1 | 1 | 0 0 0 0 1 | |
| ⋮ | ⋮ | ⋮ | |
| 1 1 1 1 1 1 0 | 1 | 1 1 1 1 0 | |
| 1 1 1 1 1 1 1 | 1 | 1 1 1 1 1 | |

ELECTRONIC MUSICAL INSTRUMENT WITH EQUALLY SPACED BINARY NOTE CODES

BACKGROUND OF THE INVENTION

This invention relates to an electronic musical instrument, more particularly a device for generating note codes by utilizing equally spaced binary codes.

In a digital electronic musical instrument, for the purpose of producing a musical tone having a frequency corresponding to the tone pitch of a depressed key of a keyboard, a binary code is used to produce a key code signal representing the depressed key.

In the case of an electronic musical instrument having 61 keys, for example, key informations or codes identifying respective ones of the 61 keys (5 octaves plus one key) are generally expressed by standard binary codes as shown in Table I, and 12 tone names are assigned as shown in the following Table II based on this concept.

TABLE I

| Data number to be designated | Binary code |
|---|---|
| 1 | 0000 |
| 2 | 0001 |
| 3 | 0010 |
| 4 | 0011 |
| 5 | 0100 |
| 6 | 0101 |
| 7 | 0110 |
| 8 | 0111 |
| 9 | 1000 |
| 10 | 1001 |
| 11 | 1010 |
| 12 | 1011 |
| 13 | 1100 |
| 14 | 1101 |
| 15 | 1110 |
| 16 | 1111 |

TABLE II

| | | Key code | |
|---|---|---|---|
| Octave | Note name | Binary code of octave data | Binary code of note name data |
| 1 | | 001 | |
| 2 | | 010 | |
| 3 | | 011 | |
| 4 | | 100 | |
| 5 | | 101 | |
| 6 | | 110 | |
| | C | | .0000 |
| | C# | | .0001 |
| | D | | .0010 |
| | D# | | .0011 |
| | E | | .0100 |
| | F | | .0101 |
| | F# | | .0110 |
| | G | | .0111 |
| | G# | | .1000 |
| | A | | .1001 |
| | A# | | .1011 |
| | B | | .1011 |

In the case of Table II, the note name data representing 12 note names C, C# . . . B assigned to fractional parts (i.e. below radix point) of the key codes and the octave data representing the octaves are assigned to integer portions of the key codes. In order to discriminate 12 tone names four bits are required and to discriminate 6 octaves 3 bits are required.

When respective note names C, C# . . . B are respectively assigned to the first to 12th binary codes ".0000"-".1011" as shown in Table II, the key codes of the chromatic notes in the same octave are expressed by an equal interdigit spacing that is ".0001" and the first to sixth octaves repeat cyclically the binary codes of ".0001"-".1000". However, the interdigit spacing corresponding to one semitone step at a transition of from one octave to the other becomes ".0101". In other words, the spacing between the binary code of the note name B and the binary code of the note name C of the next octave is ".0101", and thus all spacings are not equal.

One method of producing a musical tone from an electronic musical instrument is a method of reading out a waveform memory device. According to this method, sampled amplitude values of a waveform to be produced are prestored in a waveform memory device and the stored values are sequentially and repeatedly read out by an address signal having a frequency determined by the key code thereby forming a musical tone waveform.

To form a read out address signal it has been proposed to regularly and repeatedly accumulate a frequency number signal having a magnitude corresponding to a numeral (hereinafter called frequency number) proportional to the frequency of a tone to be produced so as to form a saw tooth shaped repetitively progressive signal having a frequency corresponding to the magnitude of the frequency number from the accumulated value. Then the repetitive frequency signal is read out and used as the address signal.

Thus, the reading and addressing operation of the waveform memory device is performed in each period of the address signal thereby producing a musical tone signal having a frequency corresponding to the frequency number.

When producing a musical tone according to this method, it is essential to obtain a frequency number signal proportional to the tone pitch, i.e., frequency of each key of the keyboard. In this manner, it is possible to cause respective generated tones to have predetermined pitches corresponding to respective keys. According to the prior art method, however, since the key code signals have been assigned to 12 note names by using standard binary codes having 16 values, when transferring from one octave to the other, the content (value) of the key code can not maintain an equal difference. For the purpose of giving a linear proportional relationship to a portion not having the equal difference, the prior art electronic musical instrument has been constructed as follows:

More particularly, as shown in FIG. 1, there is provided a frequency number signal generator 1 having a ROM capable of storing linear numerical information over the entire tone range of the keyboard. A key code signal KC, containing key codes shown in Table II and formed by a key assignor 4 acting as a depressed key detector and operated by a key switch 3 responsive to a depressed key 2, is applied to the ROM in the frequency number signal generator 1 to act as an address signal.

Then, a numerical value output having a magnitude corresponding to a key designated by the key code signal KC is read out from the ROM in the frequency number signal generator 1 and the output is sent out as a frequency number signal F which has a content regarding the numerical value information (i.e. the frequency numbers) having a linear characteristic over the entire tone range of the keyboard.

The frequency number signal F is multiplied with the output PT of a pitch modifying data generator 5 in a multiplier 6 for applying an effect to the musical tone. The product F·PT is applied to a accumulator 7 as an input to be accumulated. The accumulator 7 sends its accumulated value to a musical tone wave generator 8 including a waveform memory device to act as a read out address signal. This prior art electronic musical instrument is disclosed in U.S. Pat. No. 3,979,996 dated Sep. 14, 1976 and invented by Tomisawa et al.

In the prior art electronic musical instrument shown in FIG. 1 it is essential to convert a key code signal KC not having a linear equal difference relationship at a portion of the numerical value content into a numerical data information having a linear equal ratio relationship in the frequency number signal generator 1.

While in the circuit shown in FIG. 1, a pitch modifying effect is applied by the multiplier 6, its construction is extremely complicated for effecting addition of a plurality of partial integrations. To simplify the multiplier 6, the frequency number signal generator 1 shown in FIG. 1 has been modified such that it does not directly memorize the linear frequency number F but, rather, memorizes the same after converting it into a logarithmic value log F and applies the logarithmic value log PT of the linear numerical information value PT to the pitch modifying data generator 5. Log PT and log F are added together by an adder sustituted for the multiplier 6 shown in FIG. 1, and its output $\log F + \log PT = \log F \cdot PT$ is converted by a lagarithm-linear converter, not shown, into a linear numerical value information F·PT which is applied to the accumulator 7 as an input to the accumulator. This modified electronic musical instrument is disclosed in Chibana et al U.S. Pat. No. 4,215,614 issued Aug. 5, 1980 entitled "Electronic Musical Instruments of Harmonic Wave Synthsizing Type".

As above described, in the prior art waveform memory device read out type digital electronic musical istrument, in order to obtain a frequency number signal F in the form of linear numerical information it is necessary to use a ROM adapted to directly store a plurality of frequency numbers F corresponding to respective tone pitches over the entire tone range of a keyboard after converting the frequency numbers F into logarithmic values. In addition, in order to apply an effect, it is necessary to provide a multiplier of a complicated construction or an adder and a linear-logarithm converting circuit. For this reason, simplification of the entire construction has been limited.

SUMMARY OF THE INVENTION

Accordingly, it is a principal object of this invention to provide an electronic musical instrument utilizing novel equally spaced binary codes.

Another object of this invention is to provide an electronic musical instrument utilizing novel binary codes capable of forming key information or codes representing the number of pairs of linear frequency numbers with an extremely simple construction.

A further object of this invention is to provide an improved electronic musical instrument capable of simplifying the entire construction by forming note codes with a novel binary code.

According to this invention these and other objects can be accomplished by providing an electronic musical instrument comprising means for producing note codes respectively having n (n is positive integer) bits representing juxtaposed notes aligned by a semitone interval step in a musical scale, the note codes to be generated being selected from a binary code table consisting of successively aligned binary values according to an order of alignment of the notes in a musical scale; the binary code table omitting either one of the largest and smallest values to be represented by the lowest m bits (when m is a positive integer smaller than n); means for generating modified note codes for repetitively adding the lowest m bits of each of the generated note codes to further lower order digits below the least significant bit of each note code; and means for producing a signal of a frequency corresponding to the modified note code.

DESCRIPTION OF THE PREFERRED EMBODIMENT

Figure 1:
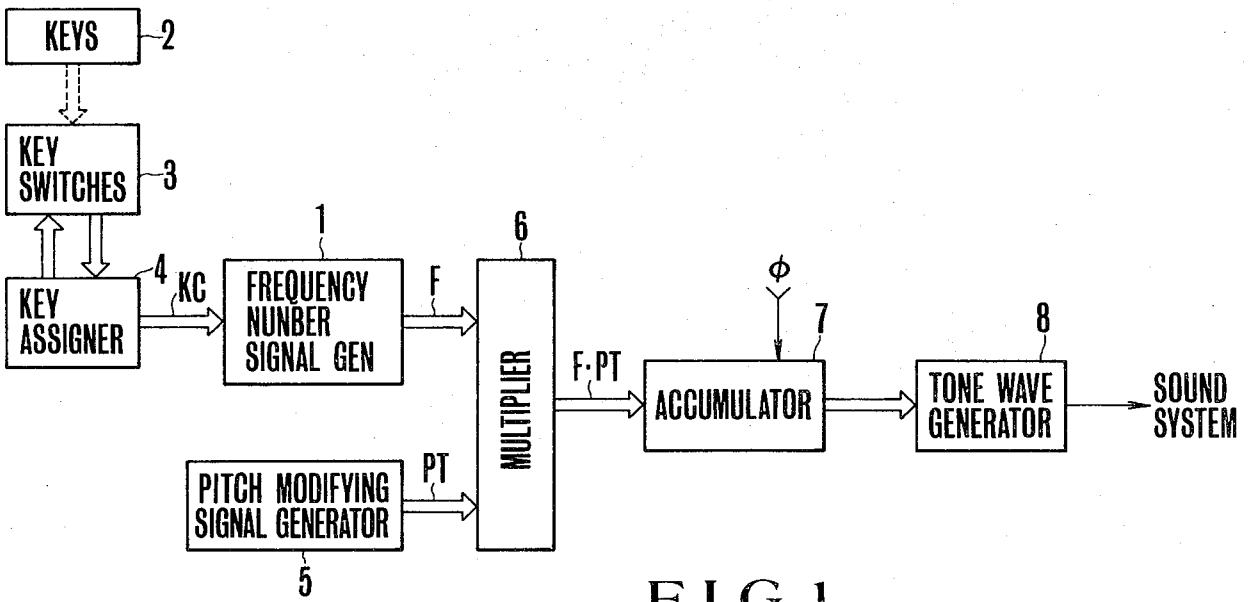
FIG. 1 PRIOR ART
FIG. 1 is a block diagram showing a prior art electronic musical instrument.

The following embodiment relates to an electronic musical instrument having 61 keys.

The principle of this invention lies in that a cyclically repeated bit portion of binary code data is repeatedly and (substantially) limitlessly added to further lower order digits below the least significant bit of the data to obtain converted code data having a lesser number of equally spaced values than that attainable by normal binary code data.

For example, as shown in the following Table III, where an input binary code data has a value of two bits at its fractional portion, two bit data "00", "01", "10" and "11" are added to the further lower order digits below the least significant values ".00", ".01", ".10" and ".11" respectively.

When the input binary code data have fractional 3 bit values as shown in Table IV, to the further lower orders of the least significant bit of the input binary code data ".000", ".001" . . . ".111" are infinitely added 3 bit data "000", "001" . . . "111" respectively.

In the same manner, where the binary code data are fractional four bit values, as shown in Table V, to the further lower order digits of the least significant orders of the input binary code data ".0000", ".0001", . . . ".1111" are infinitely added four bit data "0000", "0001" . . . "1111" respectively.

TABLE III

| Given code data | Converted code data | | | | |
|---|---|---|---|---|---|
| | Binary values | | | | Name |
| .00 | .00 | 00 | 00 | . . . | S31 |
| .01 | .01 | 01 | 01 | . . . | S32 |
| .10 | .10 | 10 | 10 | . . . | S33 |

TABLE III-continued

| Given code data | Converted code data | | | | |
|---|---|---|---|---|---|
| | Binary values | | | | Name |
| .11 | .11 | 11 | 11 | ... | S34 |

TABLE IV

| Given code data | Converted code data | | | | |
|---|---|---|---|---|---|
| | Binary values | | | | Name |
| .000 | .000 | 000 | 000 | ... | S41 |
| .001 | .001 | 001 | 001 | ... | S42 |
| .010 | .010 | 010 | 010 | ... | S43 |
| .011 | .011 | 011 | 011 | ... | S44 |
| .100 | .100 | 100 | 100 | ... | S45 |
| .101 | .101 | 101 | 101 | ... | S46 |
| .110 | .110 | 110 | 110 | ... | S47 |
| .111 | .111 | 111 | 111 | ... | S48 |

TABLE V

| Given code data | Converted code data | | | | |
|---|---|---|---|---|---|
| | Binary Value | | | | Name |
| .0000 | .0000 | 0000 | 0000 | ... | S501 |
| .0001 | .0001 | 0001 | 0001 | ... | S502 |
| .0010 | .0010 | 0010 | 0010 | ... | S503 |
| .0011 | .0011 | 0011 | 0011 | ... | . |
| .0100 | .0100 | 0100 | 0100 | ... | . |
| .0101 | .0101 | 0101 | 0101 | ... | . |
| .0110 | .0110 | 0110 | 0110 | ... | . |
| .0111 | .0111 | 0111 | 0111 | ... | . |
| .1000 | .1000 | 1000 | 1000 | ... | . |
| .1001 | .1001 | 1001 | 1001 | ... | . |
| .1010 | .1010 | 1010 | 1010 | ... | . |
| .1011 | .1011 | 1011 | 1011 | ... | S512 |
| .1100 | .1100 | 1100 | 1100 | ... | S513 |
| .1101 | .1101 | 1101 | 1101 | ... | S514 |
| .1110 | .1110 | 1110 | 1110 | ... | S515 |
| .1111 | .1111 | 1111 | 1111 | ... | S516 |

When expressed in terms of binary values these converted code data have values each corresponding to the sum of infinite geometrical progressions. Since its common ratio q is smaller than 1, the sum converges as expressed by the following equation $$S_\infty = a/(1-q) \tag{1}$$

where a represents a first term. Expressing each value shown in Table III in terms of a decimal value, since in the first value S31, a=0 and q=0

$$S31 = 0 + 0 + 0 + \ldots \tag{2}$$

$$= \frac{0}{1-0}$$

In the second value S32 since $a=\frac{1}{4}$ (a binary value "0.01" is equal to a decimal $\frac{1}{4}$) and $q=\frac{1}{4}$ $$S32 = \tfrac{1}{4} + \tfrac{1}{4}\cdot\tfrac{1}{4} + \tfrac{1}{4}\cdot\tfrac{1}{4}\cdot\tfrac{1}{4} + \ldots \tag{3}$$

$$= \frac{\frac{1}{4}}{1-\frac{1}{4}} = \tfrac{1}{3}$$

Furthermore in the third value S33 since a=2/4 (binary "0.10" is equal to decimal $\frac{3}{4}$) and $q=\frac{1}{4}$ $$S33 = \frac{2}{4} + \frac{2}{4}\cdot\tfrac{1}{4} + \frac{2}{4}\cdot\tfrac{1}{4}\cdot\tfrac{1}{4} + \ldots \tag{4}$$

-continued $$= \frac{\frac{2}{4}}{1-\frac{1}{4}} = \tfrac{2}{3}$$

In the fourth value S34 since $a=\frac{3}{4}$ and $q=\frac{1}{4}$ $$S34 = \tfrac{3}{4} + \tfrac{3}{4}\cdot\tfrac{1}{4} + \tfrac{3}{4}\cdot\tfrac{1}{4}\cdot\tfrac{1}{4} + \ldots \tag{5}$$

$$= \frac{\frac{3}{4}}{1-\frac{3}{4}} = \frac{3}{3}$$

Respective values shown in Tables IV and V can be obtained in the same manner. In the case of Table IV, for each of the values S41, S42, S43 . . . S48, since a=0, $\frac{1}{8}$, 2/8 . . . $\frac{7}{8}$ and $q=\frac{1}{8}$ the values S41, S42, S43 . . . become 0/7, 1/7, 2/7, . . . 7/7 respectively. In the case of Table V, since a=0, 1/13, 2/13 . . . 15/13 and q=1/16, the values S501, S502, S503 . . . S516 become 0/15, 1/15 . . . 15/15, respectively.

Converged values of respective values thus obtained and shown in Tables III, IV and V are shown in the following Tables VI, VII and VIII.

TABLE VI

| Given data code | Converged values of converted code data |
|---|---|
| .00 | S31 = 0/3 |
| .01 | S32 = 1/3 |
| .10 | S33 = 2/3 |
| .11 | S34 = 3/3 |

TABLE VII

| Given code data | Converged values of converted code data |
|---|---|
| .00 | S31 = 0/3 |
| .01 | S32 = 1/3 |
| .10 | S33 = 2/3 |
| .11 | S34 = 3/3 |

TABLE VIII

| Given code data | Converged values of converted code data |
|---|---|
| .0000 | S501 = 0/15 |
| .0001 | S502 = 1/15 |
| .0010 | S503 = 2/15 |
| .0011 | S504 = 3/15 |
| .0100 | S505 = 4/15 |
| .0101 | S506 = 5/15 |
| .0110 | S507 = 6/15 |
| .0111 | S508 = 7/15 |
| .1000 | S509 = 8/15 |
| .1001 | S510 = 9/15 |
| .1010 | S511 = 10/15 |
| .1011 | S512 = 11/15 |
| .1100 | S513 = 12/15 |
| .1101 | S514 = 13/15 |
| .1110 | S515 = 14/15 |
| .1111 | S516 = 15/15 |

As can be noted from Tables VI, VII and VIII, the converted code data values obtained by infinitely adding 2, 3 or 4 bits to the further lower order digits below the least significant bit of the given code, data shown in Tables III, IV and V are converged values with equal spacings therebetween. However, the given code data shown in Tables III, IV and V vary cyclically as the integers of the bits above the radix point increase, so that the values of the converted code data also repeat cyclically.

Considering now a case wherein two bits are repeatedly and infinitely added to the further lower digits of the least significant bits as shown in Table III, and supposing that where values of fractional 4 bits are given as the input code data as shown in Table IX, 16 values of ".00000000"-".11111111" would be obtained as the converted code data.

TABLE IX

| Given code data | Converted code data | Converged values |
|---|---|---|
| .00 00 | .00 00 00 00 . . . | 0/12 |
| .00 01 | .00 01 01 01 . . . | 1/12 |
| .00 10 | .00 10 10 10 . . . | 2/12 |
| .00 11 | .00 11 11 11 . . . | 3/12 |
| .01 00 | .01 00 00 00 . . . | 3/12 |
| .01 01 | .01 01 01 01 . . . | 4/12 |
| .01 10 | .01 10 10 10 . . . | 5/12 |
| .01 11 | .01 11 11 11 . . . | 6/12 |
| .10 00 | .10 00 00 00 . . . | 6/12 |
| .10 01 | .10 01 01 01 . . . | 7/12 |
| .10 10 | .10 10 10 10 . . . | 8/12 |
| .10 11 | .10 11 11 11 . . . | 9/12 |
| .11 00 | .11 00 00 00 . . . | 9/12 |
| .11 01 | .11 01 01 01 . . . | 10/12 |
| .11 10 | .11 10 10 10 . . . | 11/12 |
| .11 11 | .11 11 11 11 . . . | 12/12 |

Considering only the fractional portions of the infinitely repetitive converted code data, the difference between adjacent data, for example a certain value ".XX111111" and an adjacent upper value ".XX000000", are substantially zero, where X does not represent specific values but merely indicates the presence of bits. Suppose now that the code data shown in Table IX vary from ".0011" to ".0100", from ".0111" to ".1000", from ".1011" to ".1100" and from ".1111" to ".0000", theoretically where "1" is added to the least significant bit of a code data ".XX111111 . . . ", the code data would change to ".XX000000 . . . ". However, since the bits of the converted code data continue infinitely, the binary value to be added to the least significant bit is an extremely small value (substantially zero). This is also true for decimal numerals.

In other cases, the variation from one value to the another is a definite value of 1/12 in terms of a decimal number as shown in Table IX, so that the variation between ".XX111111 . . . " to ".XX000000 . . . " can be neglected.

Thus, when the infinitely repetitive converted code data varies frrom ".XX111111 . . . " to ".XX000000 . . . " the expressions of the data vary noticeably, while, the difference in the contents of these two data is substantially zero.

Although in Table IX, the converged values of the converted code data and shown to abruptly vary from "12/12" to "0/12" when the code data changes from ".1111" to ".0000", since the given data ".0000"-".1111" are repeated cyclically it may be considered that the values ".00000000 . . . " and ".11111111 . . . " of the converted data have the same meaning.

In the foregoing description, two bits of a given code data were repetitively added to the next-(lower side) of its least significant bit but 3, 4 or more bits can be similarly added cyclically.

Thus, generally stated, the binary values "00000 . . . " and "111111" of the converted code data may be considered substantially equal when one considers their contents.

Of the binary values of the converted code data either one of "111111 . . . " and "000000 . . . " may be omitted.

Thus, when n bits are repetitively added, the number of sets of the values of the code data may be reduced to $(2^n-1)$.

With the converted code data of this invention based on this concept, the number of sets of the values becomes 12 as shown in the following Table X by decreasing one for each set of four values, when n=2 as shown in Table IX. With this measure, the interdigit spacings between adjacent values become equal (in the case shown in Table X, 1/12).

TABLE X

| Given code data | Converted code data | Converged values |
|---|---|---|
| .0001 | .00 01 01 01 . . . | 1/12 |
| .0010 | .00 10 10 10 . . . | 2/12 |
| .0011 | .00 11 11 11 . . . | 3/12 |
| .0101 | .01 01 01 01 . . . | 4/12 |
| .0110 | .01 10 10 10 . . . | 5/12 |
| .0111 | .01 11 11 11 . . . | 6/12 |
| .1001 | .10 01 01 01 . . . | 7/12 |
| .1010 | .10 10 10 10 . . . | 8/12 |
| .1011 | .10 11 11 11 . . . | 9/12 |
| .1101 | .11 01 01 01 . . . | 10/12 |
| .1110 | .11 10 10 10 . . . | 11/12 |
| .1111 | .11 11 11 11 . . . | 12/12 |

According to this invention it is possible to convert a standard binary code data having 16 values of fractional 4 bits into binary code data having 12 values of equal interdigital spacing. These binary code data having 12 values can be used as note data representing 12 note names in one octave. Thus as shown in Table XI, respective note names of C through B of 12 note names are assigned to 12 values obtained from Table X, and 3 bit binary values "001"-"110" representing the octave number are added to the integer portions.

TABLE XI

| Converted code data | Assigned note | Converged values |
|---|---|---|
| 001.00010101 | C 2 | $1\frac{1}{12}$ |
| 001.00101010 | C# 2 | $1\frac{2}{12}$ |
| 001.00111111 | D 2 | $1\frac{3}{12}$ |
| 001.01010101 | D# 2 | $1\frac{4}{12}$ |
| 001.01101010 | E 2 | $1\frac{5}{12}$ |
| 001.01111111 | F 2 | $1\frac{6}{12}$ |
| 001.10010101 | F# 2 | $1\frac{7}{12}$ |
| 001.10101010 | G 2 | $1\frac{8}{12}$ |
| 001.10111111 | G# 2 | $1\frac{9}{12}$ |
| 001.11010101 | A# 2 | $1\frac{10}{12}$ |
| 001.11101010 | A# 2 | $1\frac{11}{12}$ |
| 001.11111111 | B 2 | $1\frac{12}{12}$ |
| 010.0010101 | C 3 | $2\frac{1}{12}$ |

TABLE XI-continued

| Converted code data | Assigned note | Converged values |
|---|---|---|
| . | . | . |
| . | . | . |
| . | . | . |
| 010.11111111 | B 3 | $2\frac{12}{12}$ |
| . | . | . |
| . | . | . |
| . | . | . |
| 101.00010101 | C 6 | $5\frac{1}{12}$ |
| . | . | . |
| . | . | . |
| . | . | . |
| 101.11111111 | B 6 | $5\frac{12}{12}$ |
| 110.00010101 | C 7 | $6\frac{1}{12}$ |

In the case shown in Table XI, the values of the converted code data have equal spacing. This will be considered from the standpoint of the pitches of the assigned notes. On an average the frequency of the tone of the (k+1)th tone among 12 tones contained in one octave is $2^{k/12}$ times of that of the first tone, and the spacing between tones has a frequency ratio of $2^{1/12}$. More particularly, the pitches of notes C#, D . . . , B of each octave are $2^{1/12}$, $2^{2/12}$, $2^{3/12}$ . . . $2^{11/12}$ times of the pitch of the note C, and spacings between tones have a frequency ratio of $2^{1/12}$ times.

The logarithm of the frequency $\alpha_k$ as normalized in ratio of the kth tone is expressed in equation (6) in which 2 is used as the base $$\log_2 \alpha_k = k/12 \quad (6)$$

where k=1, 2, . . . 12.

Thus, the result of equation (6) coincides with the converged value shown in Table X.

In equation (6) let us expand the value of k beyond the range of one octave. Thus, as the k increases as k=13, 14, . . . the value of the righthand term of equation (6) increases as a mixed number, and this also coincides with the relationship of the converged values shown in Table XI.

From the foregoing investigation, it can be noted that the converged values shown in Table XI are expressed as logarithms of the frequencies of all notes taking 2 as the base. Thus, the converted code data represent the logarithms of the values (hereinafter termed a note representing value) corresponding to the frequencies of respective notes.

For example, speaking of the code data of note $E_3$, it can be expressed as $$010.01101010$$

$$=2(5/12)=2.416=\log_2 5.3393 \quad (7)$$

Accordingly, the note representing value $\alpha_{E3}$ can be shown as follows.

$$\alpha_{E3}=5.3393 \quad (8)$$

On the other hand, the note E4 can be expressed as $$011.01101010$$

$$=3(5/12)=3.416=\log_2 10.6787 \quad (9)$$

Accordingly, the note representing value $\alpha_E$ can be shown by $$\alpha_{E4}=10.6787 \quad (10)$$

Furthermore, note E5 can be expressed as $$100.01101010$$

$$=4(5/12)=4.416=\log_2 21.3574 \quad (11)$$

Thus, the note representing value $\alpha_{E5}$ can be shown by $$\alpha_{E5}=21.3574 \quad (12)$$

However, as clearly shown by equations (8), (10) and (12), the ratios between the note representing values $\alpha_{E3}$, $\alpha_{E4}$ and $\alpha_{E5}$ are respectively 2. Thus, as defining $$\alpha_{E3}=\alpha_o, \quad (13),$$

then $$\alpha_{E4}=2\alpha_o \quad (14)$$

$$\alpha_{E5}=4\alpha_o \quad (15)$$

This means that $\alpha_{E3}$, $\alpha_{E4}$ and $\alpha_{E5}$ represent the frequency relationships of notes E3, E4 and E5 in an octave relationship.

In the case of note F5 one semitone higher than the note E5

$$100.011111111$$

$$=4(6/12)=4.500=\log_2 22.6274$$

$$=\log_2 (\alpha_{E5}\times 1.05946) \quad (16)$$

where a value 1.05946 means a semitone interval.

When respective notes are assigned to the converted code data shown in Table XI, values corresponding to the respective notes can be obtained with respect to a reference frequency.

As shown in the following Table XII, when the content of the first bit of an integer portion of a key code signal is "1" (that is, when a code data of "001.0000000000" is given), the frequency of the musical tone signal becomes 1200 cents above the reference frequency, whereby a musical signal of a pitch of 1200 cents higher than the reference note would be produced.

On the other hand, respectively when the content of the second bit and the third bit of the integer portion is "1" (that is, when code data of "010.0000000000" and "100.0000000000" is given), a musical tone having a pitch of $1200\times 2^n$ cents (n=1 and 2 respectively) would be produced, and correspondingly when the content of the first bit, second bit, . . . 10th bit of the fractional portion is "1", that is, respectively when code data of "000.1000000000", "000.0100000000" . . . "000.0000000001" is given, a musical tone having a pitch of $1200\times2^2$ cents (n=−1, −2, . . . −10 respectively) would be produced.

TABLE XII

| Key code signal | Pitch (in cents) |
|---|---|
| 100.0000000000 | 4800 |
| 010.0000000000 | 2400 |
| 001.0000000000 | 1200 |
| 000.1000000000 | 600 |
| 000.0100000000 | 300 |
| 000.0010000000 | 150 |
| 000.0001000000 | 75 |
| 000.0000100000 | 37.5 |
| 000.0000010000 | 18.75 |
| 000.0000001000 | 9.375 |
| 000.0000000100 | 4.6875 |
| 000.0000000010 | 2.34375 |
| 000.0000000001 | 1.171875 |

When the content of a key code data increases by "001.0000000000", the frequency of the musical tone increases by one octave (1200 cents). Further, when "000.0001010101" is added to the content of a key code, the frequency of the musical tone increases by a semitone (100 cents), whereas when its complement "111.1110101010" is added (this means a subtraction), the frequency of the musical tone decreases by a semitone (100 cents). In the same manner addition of "000.0000001000" and "000.0000101010" respectively results in the increase of 10 and 50 cents respectively of the frequency of the musical tone.

A vibrato effect may be imparted by adding "000.0000000001" through "000.0000011111" and "111.1111111110" through "111.1111100000" to the content of a key code data, in which case the width of the frequency of the musical tone varies by 1.172 through 36.3 cents.

To impart a glide effect, "111.1110000000" is added to the content of a key code data (this means subtraction of "000.0001111111") and thereafter the addend is gradually increased to "111.1111111111". Then the pitch of the musical tone suddenly decreases by about 150 cents and thereafter gradually restores to the original pitch.

The formation of key codes for an electronic musical instrument based on the principle described above can be realized by a circuit shown in FIG. 2.

Figure 2:
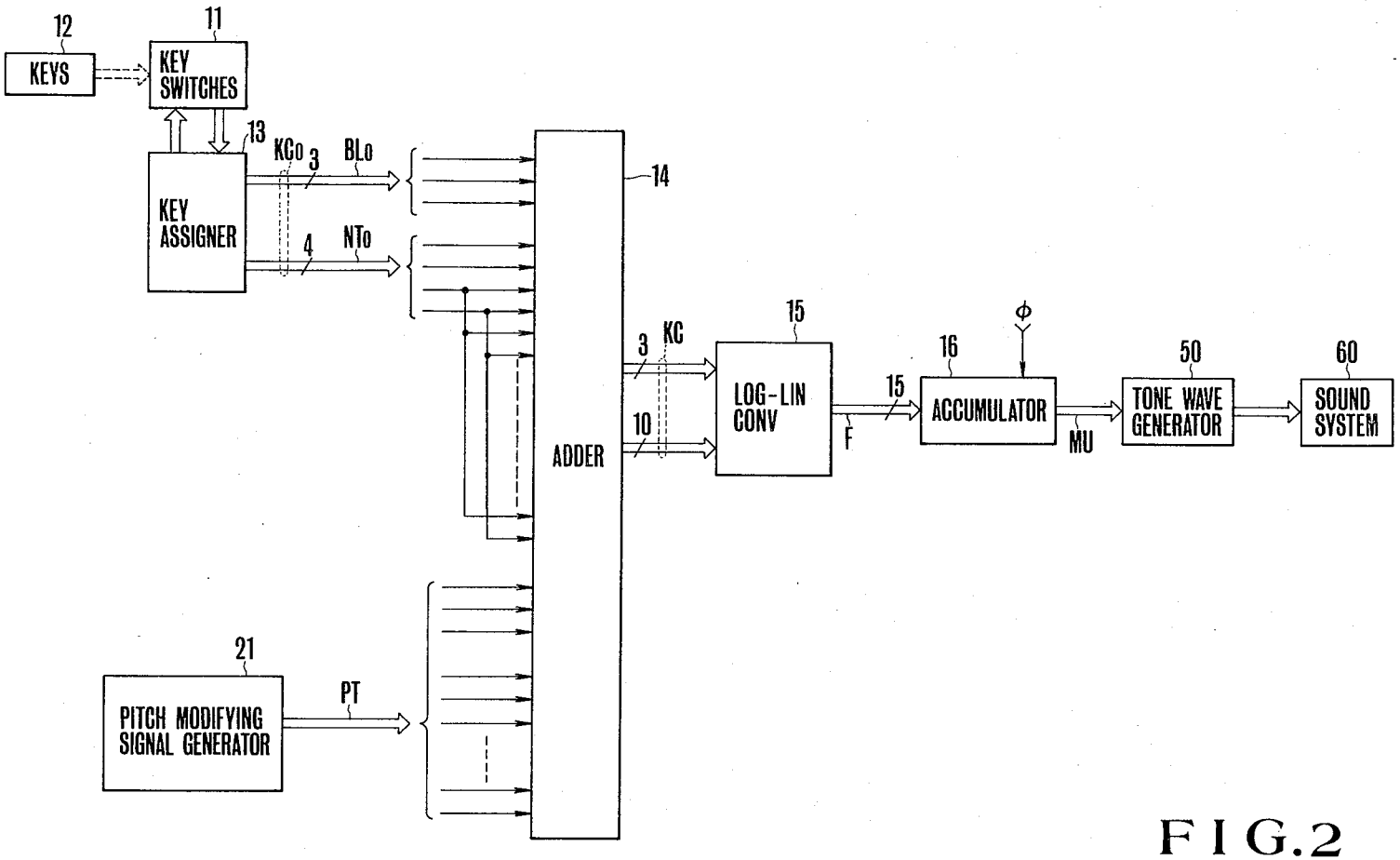
FIG. 2 is a block diagram showing one of the electronic musical instrument embodying the invention.

The circuit shown in FIG. 2 comprises a key switch group 11 corresponding to sixty-one (61) keys 12. These sixty-one key switches are divided into a plurality of blocks, each of which is sequentially scanned by a key assigner 13. This type of key assigner is disclosed in U.S. Pat. No. 4,148,017 dated Apr. 3, 1978. The blocks are divided into octave units. Thus, notes C2 through B2, C3 through B3, . . . and C6 through B6 are divided into five (first through fifth) blocks whereas note C7 is alloted to the 6th block. The key assigner 13 sequentially scans from the first to 6th blocks to produce a detected block signal BLo consisting of outputs on three output lines. The assigner 13 also scans the key switches 11 corresponding to note names C through B belonging to each block to produce a detected note signal $NT_o$ consisting of outputs on four output lines representing the note name of the depressed key, if any. The detected block signal BLo is expressed by a 3 bit binary value, whereas the detected note signal NTo is expressed by a 4 bit binary value. As shown by the "given code data" in Table X, the detected note signals NTo have contents as if note names C through B were assigned to 12 values of ".0001" through ".1111" remaining after omitting four values of ".0000" ".0100", ".1000" and ".1100" from sixteen standard binary values.

Thus the detected block signal BLo is applied to an adder 14 as an integer bit input. On the other hand, the detected note signal NTo is applied to the adder 14 as a fractional bit input, and moreover its two lowest bits are repeatedly applied to the adder 14 to act as further lower order bits below the least significant bit of the fractional portion of the detected 7-bit code. In this manner 7 bit detected key code signals KCo appear at the output of the key assignor 13, while converted key code signals KC same as the "converted code data" in Table XI appear on the output of the adder 14.

In the circuit shown in FIG. 2, the fractional bit signals inputted to and outputted from the adder 14 comprise 10 bits as shown in Table XIII whereby an approximate mathematical operation of the key code signal is made within a permissible error range. The data shown as the "converted code data" in Table XI are theoretically expressed as infinite geometrical progressions. However, when one considers the influence upon the pitches of respective notes, it is sufficient to utilize the abovementioned 10 bits as shown in Table XIII for practical use.

TABLE XIII

| Key code signals KC | Notes |
|---|---|
| 001.0001010101 | C 2 |
| 001.0010101010 | C# 2 |
| 001.0011111111 | D 2 |
| 001.0101010101 | D# 2 |
| 001.0110101010 | E 2 |
| 001.0111111111 | F 2 |
| 001.1001010101 | F# 2 |
| 001.1010101010 | G 2 |
| 001.1011111111 | G# 2 |
| 001.1101010101 | A 2 |
| 001.1110101010 | A# 2 |
| 001.1111111111 | B 2 |
| 010.0001010101 | C 3 |
| . | . |
| . | . |
| . | . |
| 010.1111111111 | B 3 |
| . | . |
| . | . |
| . | . |
| 101.0001010101 | C 6 |
| . | . |
| . | . |
| . | . |
| 101.1111111111 | B 6 |
| 110.0001010101 | C 7 |

The converted key code signals KC thus formed by the adder 14 are converted into repetitive frequency signals having predetermined tone pitches by a frequency converter (or a log-linear converter) 15 and an accumulator 16.

Figure 3:
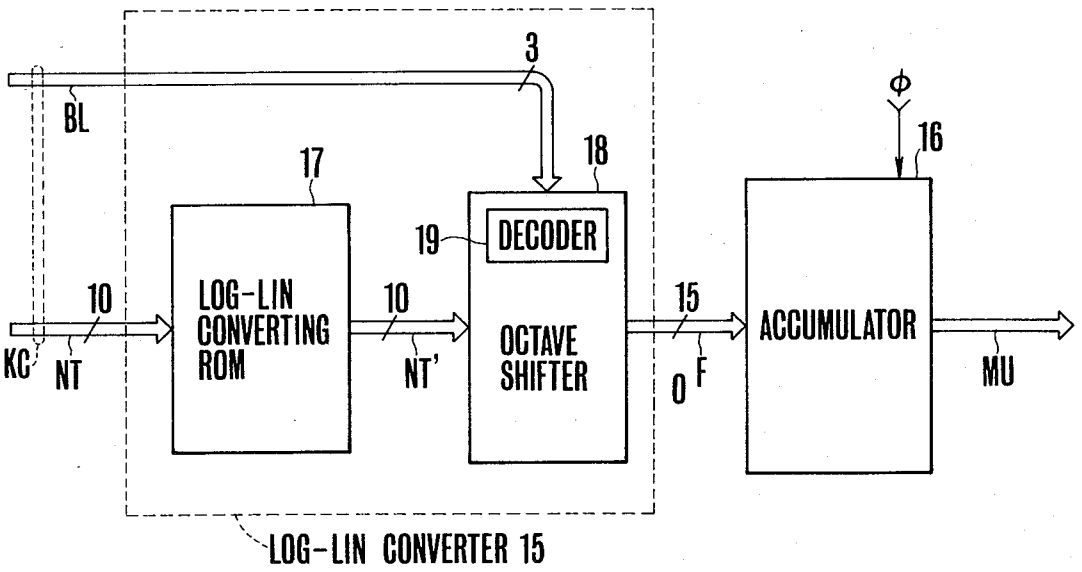
FIG. 3 is a connection diagram showing one example of the frequency converter shown in FIG. 2.

The frequency converter 15 converts the converted key code signal KC which are in the form of logarithmic tone pitch information into a frequency number signal F which are in the form of linear tone pitch information. As shown in FIG. 3, the frequency converter 15 comprises a logarithm-linear converting ROM 17, and a note signal NT constituted by the fractional 10 bit portion of the converted key code signal KC is applied to act as a reading out input of ROM 17. The ROM 17 stores values $K\alpha$ corresponding to the real value $\alpha$ for the note signals ($=\log_2 \alpha$) of respective key codes shown in Table XIII thereby converting logarithmic 10 bit note signals NT into 10 bit note signals NT' of a natural number form corresponding to the real number $\alpha$ of the note signal NT.

The note signal NT' is applied to an octave shifter 18 in which a binary value comprising the content of the note signal NT' is shifted according to the content of the octave signal BL. The octave shifter 18 is constituted by a shift register, for example, so that the octave signal BL is converted into a shift signal by a decoder 19 to shift toward the upper order by the number of octaves the note signal NT' stored in the shift register. Since the note signal NT' is a linear real value comprising the note representing value, the outputs after being shifted would have a content of $2^n$ times of the input signal when it is shifted by one, two, . . . bits (where n=1, 2, . . . ). This coincides with the fact that the frequencies of the tones having an octave relationship have a relation of $2^n$. Thus, the shifter 18 applies to the accumulator 16 a frequency number signal F having an amount corresponding to each note pitch.

The accumulator 16 repetitively accumulates the frequency number signal F at timings of a sampling pulse $\phi$ (supplied from a pulse generator, not shown) having a sampling frequency $f_s$ (Hz) and when its accumulated value exceeds a modulo M, this value M is subtracted from the accumulated value, and the remaining value is again repetitively accumulated. Thus, the accumulator 16 forms a saw tooth shaped repetitive frequency signal which varies in accordance with the variation in the accumulated value. The period of this repetitive frequency signal MU is proportional to the magnitude of the frequency number signal F.

The repetitive frequency signal MU appearing at the output of the accumulator 16 is used as a reading out signal of a waveform memory device contained in a tone wave generator 50. Thus by repetitively reading out the waveform stored in the waveform memory device at a frequency of the repetitive frequency signal MU, a musical tone signal is produced having a pitch corresponding to the key code signal KCo and the musical tone signal is sent to a sound system 60 to produce a musical tone.

According to the circuit construction shown in FIG. 3, the converted key code signal KC applied to the frequency converter 15 has a sum of a value $\beta$ of the integer portion of the octave signal BL and a value $\log_2 \alpha$ of the fractional portion of the note signal NT as shown by the following equation.

$$(\text{octave signal})+(\text{note signal})=\beta.\log_2 \alpha \quad (17)$$

The fractional portion ($.\log_2 \alpha$) on the righthand side is converted into a real number $K\alpha$ by the shift operation of the logarithm-linear converting ROM 17 and is multiplied with $2^\beta$ by the shifting operation of the shifter 18. As a consequence, the value of the frequency number signal F produced by the shifter 18 is:

$$F=2^\beta \cdot K\alpha \quad (18)$$

This frequency number signal F is converted into a repetitive and progressive signal MU by the accumulator 16, and the signal MU thus obtained has a frequency $$f_M=(F \cdot fs)/M \quad (19)$$

Determining the constant K of the ROM 17 with reference to note A4, for example, since the musical tone frequency $f_{MA4}$ of the note A4 is equal to 440 Hz, the detected key code signal KCo at the output of the key assigner 13 becomes "011.1101". Since the binary value "011" of the octave signal BLo is "3" in terms of decimal value, $\beta$ becomes equal to 3. As shown in Tables X and XI, the binary value ".1101010" obtained by converting the binary value ".1101" regarding the note signal NTo is about 10/12 in terms of decimal value so that $\alpha=10/12$.

Substituting these values into equation (18), $$F=2^3 \cdot K \cdot 2^{10/12} \quad (20)$$

Assuming that $f_s$=25 kHz and that M=1024 and substituting these values into equation (19), $$F=(1024/25000) \cdot 440 \quad (21)$$

Accordingly, K can be obtained as follows from equations (20) and (21):

$$K=(440 \cdot 1024)/(25000 \cdot 2^3 \cdot 2^{10/12})=1.2643412 \quad (22)$$

As a consequence, a real value $\alpha_i=\alpha 1.2643412$ (where $\alpha_i$ represents the frequency of each note) comprising the note representing value is stored in the logarithmic-linear converting ROM 17 which is addressed by a note code signal NT (its content is a logarithm of the tone pitch information value) of the 10 bit fractional portion obtained at the output of adder 14.

A pitch modifying signal PT from a pitch modifying signal generator 21 is added to the adder 14 to be added to the detected key code signal KCo from the key assigner 13. The pitch modifying signal PT varies the frequency of the repetitive frequency signal MU produced by the accumulator 16 to apply vibrato effect or glide effect to the musical tone.

Figure 4:
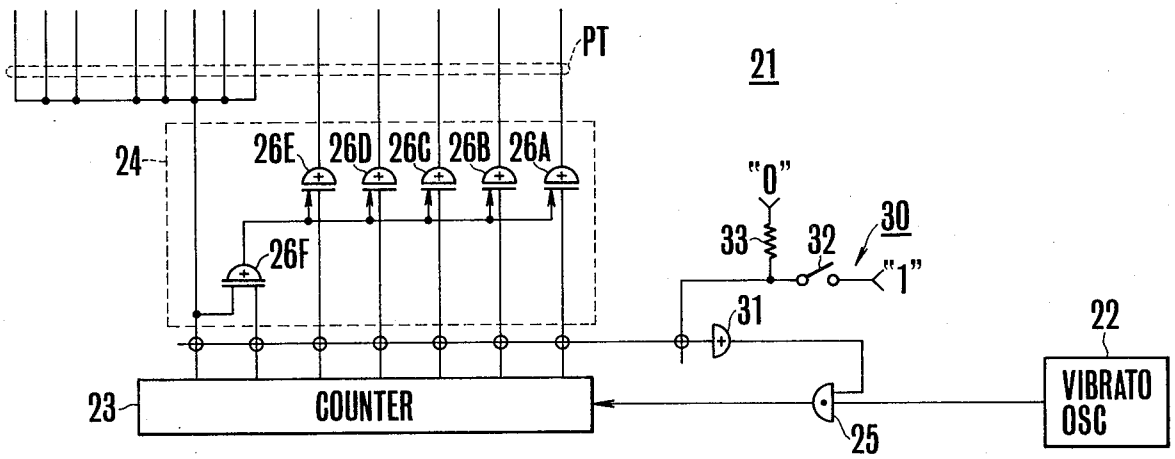
FIG. 4 is a connection diagram showing one example of the pitch modifying signal generator shown in FIG. 2.

As shown in FIG. 4 the pitch modifying signal generator 21 comprises a vibrato oscillator 22 (for example a rectangular waveform oscillator having a frequency of 896 Hz), a 7 bit binary counter 23 which counts the number of the outputs of the oscillator, and a logic circuit 24 which converts the vibrato signal into the pitch modifying signal according to the output of each bit of the binary counter.

The output pulse of the vibrato oscillator 22 is applied to the input of binary counter 23 via an AND gate circuit 25. The first to fifth bit outputs of the binary counter 23 are respectively applied to one input of exclusive OR gate circuits 26A to 26E, while the 6th and 7th outputs are applied to both inputs of a 6th exclusive OR gate circuit 26F, the output thereof being applied to the other input of the first to 5th exclusive OR gate circuits 26A to 26E so as to produce outputs of lowest 5 bits among 10 bits of the fractional portion of the pitch modifying signal PT. The content of the 7th or the most significant bit is directly sent out as the output constituting 3 bits of the integer portion and highest 5 bits among 10 bits of the fractional portion.

Figure 5:
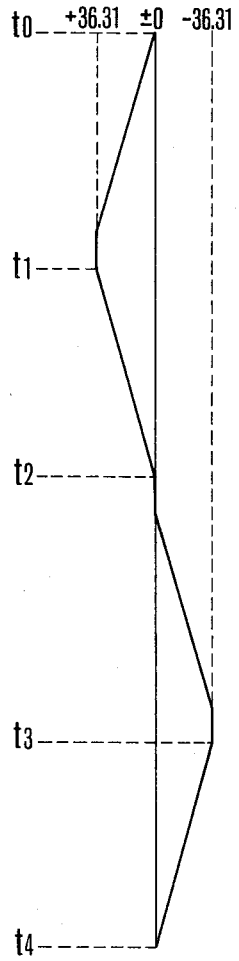
FIG. 5 is a graph for explaining the relation between the outputs of the counter and logic circuit shown in FIG. 4 and the variation of the pitch modifying signal.

Under a condition in which all output bits of the binary counter 23 are "0" when the output pulse of the oscillator 22 is applied thereto through the AND gate circuit 25, since the output of the 6th exclusive OR gate circuit 26F is "0" when the 6th and 7th output bits are both "0", as shown in FIG. 5, as the first to fifth bits of the counter 23 becomes "00000" through "11111", these bits are outputted through the first through fifth exclusive OR gate circuits 26A to 26E. Under these condition the pitch modifying signal PT continues to increase from "000.0000000000" to "000.0000011111".

When the 6th output bit of the counter 23 becomes "1" at a time t1, the output of the 6th exclusive OR gate circuit 26F becomes "1" while at the same time the content of the first through fifth counter 23 returns to "00000" so that the outputs of the first through fifth exclusive OR gate circuits 26A to 26E become "11111". Under these condition as the contents of the first through fifth bits of the counter 23 increases from "00001" to "11111" the outputs of the first through fifth exclusive OR gate circuit 26A to 26E decrease from "11110" to "00000". Thus, the pitch modifying signal PT decreases from 000.0000011110 to "000.0000000000" taking "000.0000011111" as a reference.

When the first through fifth bit outputs of the counter 23 becomes "00000" at time t2, while at the same time, when the 6th and 7th output bits becomes "0" and "1" respectively, the output of the 6th exclusive OR gate circuit 26F still maintains "1" state so that the pitch modifying signal PT becomes "111.1111111111" and then varies from "111.1111111110" to "111.1111100000". This variation of the pitch modifying signal PT represents a variation of the complement. Hence addition of this complement by the adder 14 means addition of gradually increasing value in negative sign.

When the first through fifth bits of the counter 23 become "00000" at time t1 and when the 6th and 7th bits become "1" and "1", the pitch modifying signal PT becomes "111.1111100000" and then varies from "111.1111100000" to "111.1111111111". Thus application of the complement of the pitch modifying signal PT to the adder 14 means addition of gradually decreasing value in negative sign.

At time t4 when the first through fifth bits become "00000" and when the 6th and 7th bits become "0" and "0" the pitch modifying signal PT becomes "000.0000000000" thus returning to the original state.

Thereafter, the pitch modifying signal generator 21 repeats the operation just described whereby the pitch modifying signal PT comprising 3 integer bits and 10 fractional bits increases in the positive direction from 0 to a maximum value and then decreases to 0. Then it decreases in the negative direction to a minimum value and thereaftr increases to 0 thereby providing a signal which varies like a triangular wave.

The output of the pitch modifying signal generator 21 is added by adder 14 to a key code signal KCo from the key assigner 13 whereby the content of the converted key code signal KC to the logarithm-linear converter 17 (FIG. 7) and hence the frequency of the musical tone signal is periodically varied (by about 7 Hz, for example) in the positive and negative directions.

At the time of imparting the vibrato effect, when the content of the pitch modifying signal PT varies by "0.0000000001", the frequency, i.e. the pitch increases or decreases by about 1.172 cents as has been described hereinabove in connection with Table XII, and at the maximum variations of "0.0000011111" and "111.1111100000" the pitch increases or decreases by 36.31 cents.

In FIG. 4, the input AND gate circuit 25 to the binary counter 23 is supplied, as an enabling control signal with an OR gate circuit 31 inputted with the output of all bits of the counter 23 and the output of a vibrato control circuit 30. The vibrato control circuit 30 comprises a vibrato switch 32 connected to a voltage source of logic "1". Upon closure of this switch 32, an enabling signal of logic "1" is applied to one input of the input AND gate circuit 25 via the OR gate circuit 31, thus enabling the same to impart a vibrato effect to the repetitive frequency signal. The movable contact of the switch 32 is connected to a voltage source of logic "0" via a relatively high resistance 33, so that when the switch 32 is opened, the enabling control signal sent out from the vibrato control circuit 30 will have logic 0 level. Accordingly, when the contents of all bits of the binary counter 23 become "0" the input AND gate 25 is disabled to stop application of the vibrato effect. In this manner the vibrato effect is applied starting from a point at which variation of the pitch is zero cent.

Where a glide effect is imparted by the pitch modifying signal generator 21 shown in FIG 2, there are provided a glide (FIG. 6) oscillator 35 for producing a rectangular pulse, a 7 bit binary counter 36 which counts the number of outputs of the glide oscillator, a counter control circuit 39 including a NAND gate circuit 37 supplied with all bit outputs of the binary counter 36 for producing an enabling signal to an input AND gate circuit 38 for the binary counter, and a glide control circuit 41 including a glide switch 40.

When the glide switch 40 is closed the output of a source of voltage of logic "1" is applied to the counter 36 as a reset signal. Then the contents of all bits of the counter 36 become "0" whereby an enabling signal of logic "1" is applied to the AND gate circuit 33 from the NAND gate circuit 37 thus applying the output of the oscillator 32 to the counter 36 via the AND gate circuit. However, while the switch 40 is being closed counter 36 is reset and does not perform any counting operation. Thereafter, when the glide switch 40 is opened, counter 36 is set to start counting.

Meanwhile all output bits of the counter 36 become "1" to deliver "0" as the output of the NAND gate 37 so that the AND gate circuit 38 is disabled to terminate the glide effect.

The bit outputs of the counter 36 are utilized as the seven lowest bits of the 10 bits of the fractional portion of the pitch modifying signal PT, and outputs corresponding to the three highest bits of the fractional portion and 3 bits of the integer portion are sent from the source of voltage of logic "1".

Figure 6:
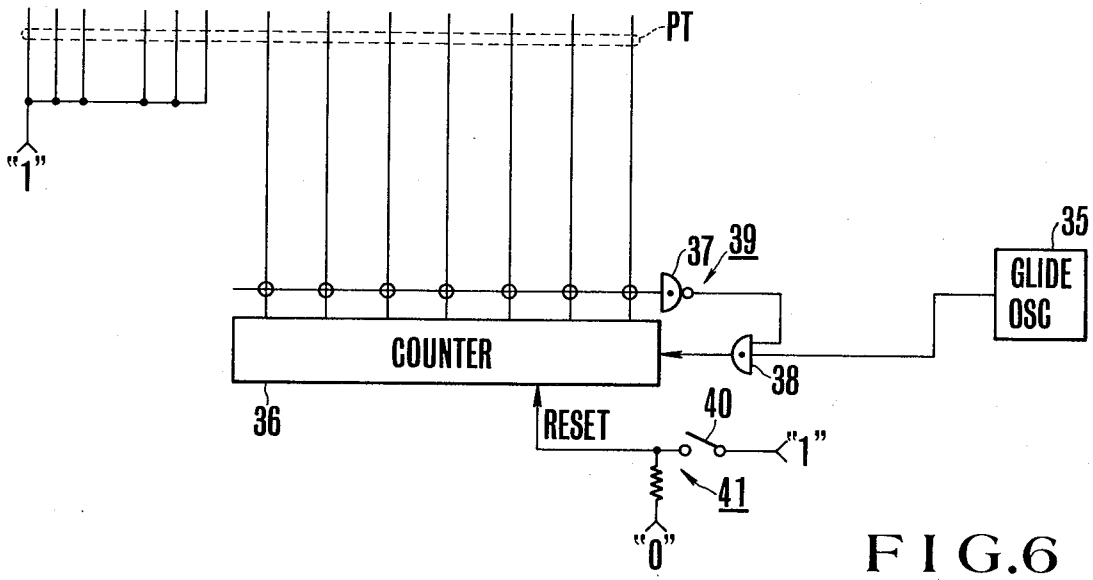
FIG. 6 is a connection diagram showing the glide control circuit.

In the circuit shown in FIG. 6, when the glide effect is not applied, the binary counter is stopped with a content of "1111111". Accordingly, the pitch modifying signal PT becomes "111.1111111111" so that the pitch of the musical tone is not changed. Under these conditions, when the glide switch 40 closed to reset the binary counter 36, the pitch modifying signal PT becomes a complement "111.1110000000" so that this signal suddenly decreases to a relatively large negative value. At the same time the input AND gate circuit 38 is enabled but the binary counter 36 is maintained in its reset state due to the closure of the glide switch 40. Thereafter, when this switch is opened, the counter 36 is released to start counting with the result that the pitch modifying signal PT changes from its complement "111.1110000001" to "111.1111111111". Accordingly the negative value decreases (approaching to zero) gradually. When the content of the binary counter 36 reaches "1111111", the input AND gate circuit 38 is disabled to restore the original state.

Figure 7:
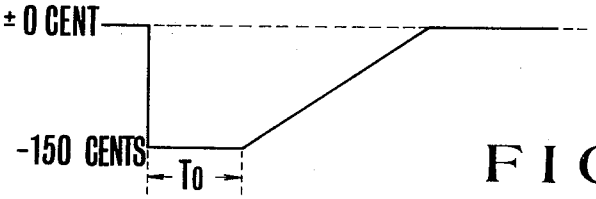
FIG. 7 is a graph for explaining the operation of the glide effect control circuit shown in FIG. 6.

When the content of the pitch modifying signal PT reaches a maximum value "111.1110000000", the frequency of the musical tone signal is reduced by about 150 cents and as shown in FIG. 7, thereafter changes by "111.1110000001" each step thereby gradually increasing the frequency of the musical signal by 1.172 cents at each step. In this manner the glide effect is imparted. In FIG. 7, an interval To shows that the largest glide is imparted as the switch 40 is closed to reset the binary counter 36.

As above described, according to this invention, a key code conversion signal is obtained by first producing a fractional 4 bit key code detection signal from the key assigner and the content of its two lowest bits are repetitively added to and below the 5th bit while repeatedly lowering the adding bit positions as if the values according to the equal ratio spacings were converted into logarithms, whereby a frequency number signal in the form of a logarithmic signal can be readily obtained with an extremely simple construction.

Accordingly, by merely adding the output of the pitch modifying data generator in the form of a logarithmic signal to the frequency number signal, a frequency number signal with pitch modifying effect can readily be obtained.

Although in the foregoing description, the converted code data shown in Table XIII were obtained by using standard binary codes "0001", "0010", "0011", "0101", "0110", "0111", "1001", "1010", "1011", "1101", "1110" and "1111" as the note code signals and 12 tone names were assigned to the set of these 12 values it is possible to form converted code data with "0000", "0001", "0010", "0100", "0101", "0110", "1000", "1001", "1010", "1100", "1101", "1110" and then assigning thereto 12 tone names.

What is claimed is:

1. An electronic musical instrument comprising:

means for producing note codes respectively having n bits (n is a positive integer) representing juxtaposed notes aligned by a semitone interval step in a musical scale, said note codes producing means including a binary code table consisting of successively aligned binary values corresponding to an order of alignment of the notes in a musical scale, said binary code table omitting those binary values corresponding to either one of the largest and smallest values normally represented in a binary series by the lowest m bits of said n bits (where m is a positive integer smaller than n);

means coupled to said producing means for generating modified note codes from said note codes, said generating means including means for repetitively adding the lowest m bits of each of said note codes to further lower order bit positions within said means for adding, below the least significant bit of said each note code; and means coupled to said generating means for producing musical tones having frequencies corresponding to said modified note codes.

2. An electronic musical instrument according to claim 1 wherein m=2.

3. An electronic musical instrument according to claim 2 wherein the binary code of the lower order two bits of the omitted binary values is "00".

4. An electronic musical instrument according to claim 2 wherein the binary code of the lower order two bits of the omitted binary values is "11".

5. An electronic musical instrument comprising:

first means for generating note codes respectively having n bits (n is a positive integer) representing juxtaposed notes aligned by a semitone interval step in a musical scale, said first means including a binary code table including successively aligned binary values corresponding to an order of alignment of said notes in a musical scale, said binary code table omitting those binary values corresponding to either one of the largest and smallest values normally represented in a binary series by the lowest order m bits of said n bits (where m is a positive integer smaller than n);

second means coupled to said first means for generating modified note codes from said note codes, said second means including means for repetitively adding the lowest m bits of each of said note codes to further lower order bit positions within said means for adding, below the least significant bit of said each note code;

a logarithm-linear converter having an input coupled to the output of said second means for receiving said modified note codes as a logarithmic input and for producing a corresponding linear output;

and means coupled to said converter for producing a musical tone having a frequency proportional to the linear output of said converter.

6. An electronic musical instrument according to claim 5 wherein the binary code of said lowest two bits of the omitted binary values is "00".

7. An electronic musical instrument according to claim 5 wherein the binary code of said lowest two bits of the omitted binary values is "11".

8. An electronic musical instrument according to claim 6 or 7 which further comprises an accumulator coupled between the output of said logarithm-linear converter and said musical tone producing means for accumulating said modified note codes over a predetermined time interval.

9. A binary code generator comprising:

means for generating binary codes of n bits (n is a positive integer), said binary codes generating means including a binary code table consisting of successively aligned binary values, said binary code table not including those binary values corresponding to one of the largest and smallest values normally represented in a binary series by the lowest m bits of said n bits (where m is a positive integer smaller than n); and a modified code generator coupled to said binary codes generating means for producing modified binary codes corresponding to said binary codes, said modified binary codes constituting a succession of binary codes juxtaposed at substantially the same interval, said modified code generator including means for adding the lowest m bits of each said binary code to further lower order bit positions within said means for adding, below the least significant bit of said each binary code.

10. An electronic musical instrument comprising:

means for producing note codes respectively having n bits (n is a positive integer) representing juxtaposed notes aligned by a semitone interval step in a musical scale, said note codes producing means including a binary code table having successively aligned binary values corresponding to an order of alignment of the notes in a musical scale, said binary code table being devoid of those binary values corresponding to either one of the largest and smallest values normally represented by the lowest m bits of said n bits (where m is a positive integer smaller than n);

means coupled to said producing means for generating modified note codes from said note codes, said generating means including means for repetitively adding the lowest m bits of each of the note codes to further lower order bit positions within said means for adding, below the least significant bit of said each note code;

an adder having a first input supplied with said modified note code and a second input;

means coupled to said adder for applying a pitch modifying signal to the second input of said adder;

a logarithm-linear converter coupled to the output of said adder for converting the output of said adder as a logarithm value into a corresponding linear output value; and means coupled to the output of said converter for producing a musical tone having a frequency proportional to said linear output.

* * * * *